United States Patent [19]

Singer

[11] 4,264,056

[45] Apr. 28, 1981

[54] HOISTING DEVICE, PARTICULARLY A BLOCK

[76] Inventor: Edouard Singer, 53, rue de Mulhouse, 68790 Morschwiller-le-Bas, France

[21] Appl. No.: 927,364

[22] Filed: Jul. 24, 1978

[30] Foreign Application Priority Data

Jul. 27, 1977 [FR] France ..... 77 23696

[51] Int. Cl.[3] ..... B66D 1/36

[52] U.S. Cl. ..... 254/391; 24/127

[58] Field of Search ..... 254/192, 191, 193, 195, 254/197, 194, 188, 167, 154, 155, 156, 150 R; 114/218; 24/127, 118

[56] References Cited

U.S. PATENT DOCUMENTS

| | | | |
|---|---|---|---|
| 869,827 | 10/1907 | Coleman | 254/191 |
| 1,671,435 | 5/1928 | McKissick | 254/197 |
| 2,343,086 | 2/1944 | Schultz | 254/192 |
| 2,677,863 | 5/1954 | St. John | 114/218 |
| 2,793,740 | 5/1957 | Daudt | 254/150 R |

*Primary Examiner*—Robert J. Spar
*Assistant Examiner*—Kenneth Noland
*Attorney, Agent, or Firm*—Robert E. Burns; Emmanuel J. Lobato; Bruce L. Adams

[57] ABSTRACT

A pulley having a fixed lateral pulley externally of the blocks thereof for variably braking a line on a rotatable sheave of the pulley.

2 Claims, 5 Drawing Figures

HOISTING DEVICE, PARTICULARLY A BLOCK

BACKGROUND OF THE INVENTION

The invention relates to a hoisting device, particularly a block.

For numerous jobs and in particular for work carried out at a certain height such as the work carried out on overhead electric lines, hoisting devices are used which, in particular, comprise a pulley making it possible to lift a load.

The devices generally used satisfy only a single function—either the pulley serves as return pulley or the pulley forms a lowering pulley.

Since a long time there has been known a hoisting device, in particular a block formed of a case provided with a fastening member at its upper part, a pin, and a sheave movable on said pin and placed between the two sides of the case, corresponding to the preamble of claim 1.

These blocks, which satisfy the conditions for these two functions, are equipped with braking baffles around which the rope is partially wound. These braking baffles are located in the vertical extension of the return pulley and in the same vertical plane as the axis of symmetry of the pulley sheave. Therefore, there is a first disadvantage which consists in the substantial increase in length of the body of the block. Now it is very desirable that the block have as small a height as possible. Moreover, these devices have a hinged cover to provide access to the baffles. This cover must be locked in open position. On the other hand, it must in no case open or close without manual action by the operator. Furthermore the rope must be threaded by hand through the baffles, which presents certain difficulties in the case of cold or wet weather and, under the effect of distraction, in case of an accident.

With respect to these lowering blocks, indicated above, certain technical problems of not insignificant importance, have remained unsolved. One of these problems resides in the fact that the rope cannot be locked. Now it is undeniable that locking is of prime importance in certain cases of rescue.

Furthermore, the untimely opening of the baffle protection cover during a handling operation may cause the ejecting of the rope out of the baffle housing. This may result in a serious accident.

These various drawbacks make the correct functioning of these devices suspect, and accordingly their use is dangerous.

SUMMARY OF THE INVENTION

The object of the present invention is to provide a solution for this difficulty. The invention, as characterized in the claims, proposes a hoisting device which satisfies the conditions of two functions. This device, in fact, serves, on the one hand, when used as return pulley block, to raise the load attached to one end of the hoisting rope towards the place of attachment of the block while carrying out the pulling forces from the ground, and, on the other hand, to hook to one strand of the rope a load, for instance a wounded or unconscious person, and lower him easily while exerting only a very slight braking force on the other strand. The invention of the device resides essentially in the design of the rope braking system.

The advantages which are obtained by means of this invention reside essentially in the fact that the system makes it possible instantaneously to transform the return pulley into a lowering pulley and thus for a single person, at the top of a support, to assure the instantaneous rescue of a person who has suffered an accident. This braking control may enter into action at any level between the ground and the point of attachment of the block. The same is true with regard to the locking of the rope, which becomes an automatic locking effected by the wedging of the rope.

For this purpose, the invention concerns a hoisting device, in particular a block, formed of a case provided at its top with a hooking member, a pin, and a sheave movable on said pin and placed between the two sides of the case, characterized by the fact that the pin has at least one fixed sheave arranged on the outside of the case and adapted to cooperate, in case of use as lowerer and/or lifter, with the movable sheave via notches provided in the side of the case arranged between the movable sheave and the fixed sheave or sheaves and permitting the passage of the rope.

BRIEF DESCRIPTION OF THE DRAWINGS

In the following, the invention is explained in further detail with reference to drawings which show only one embodiment.

Figure 1:
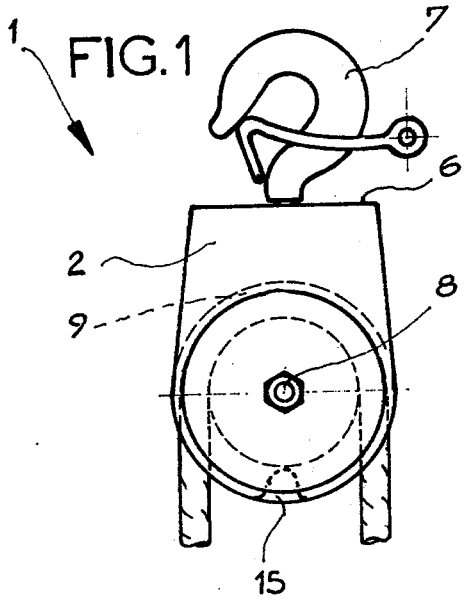
FIG. 1 is a view in elevation of the hoisting device in accordance with the invention.
Figure 2:
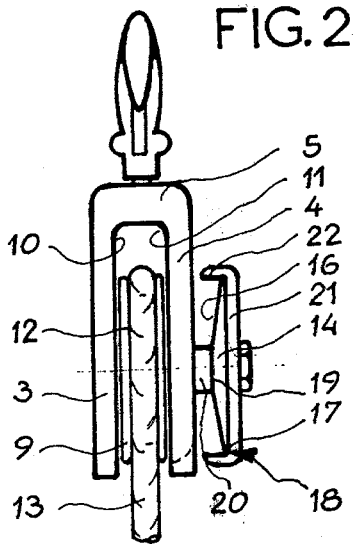
FIG. 2 is a side view of this device.
Figure 3:
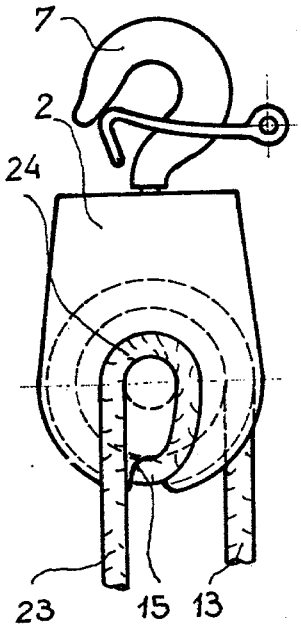
FIG. 3 is a view in elevation of the device while being used as lowerer.
Figure 4:
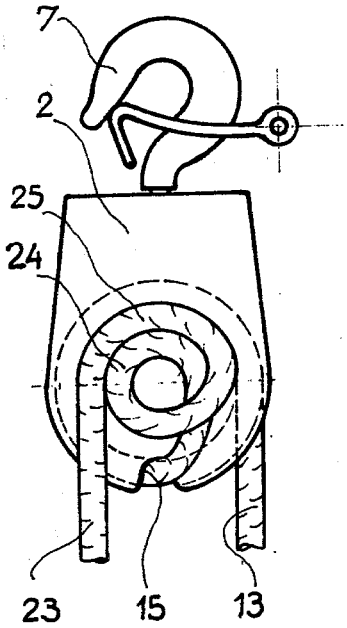
FIG. 4 is a view in elevation of the device with cord locked.
Figure 5:
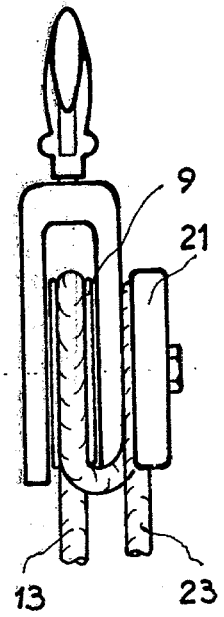
FIG. 5 is a side view of the device showing the cooperation between the movable sheave and the fixed sheave.

The device 1 comprises a case 2 formed of two vertical sides 3 and 4 connected together by a transverse wall 5. This transverse wall 5 is provided on its outer face 6 with a fastening member 7, such as a hook. The two vertical sides 3 and 4 are traversed by a pivot pin 8. On this pivot pin 8 there can freely pivot a movable sheave 9 placed between the inner faces 10, 11 of the two vertical sides 3, 4. This movable sheave 9 has a groove 12 around which a handling rope 13 is partially wound.

The pivot pin 8 protrudes out from one of the side walls 4 and on this protruding end there is placed at least one second sheave 14, which is fixed for rotation. A notch 15 is provided in the wall 4 to permit the passage of the handling rope 13.

The fixed sheave 14 has a conical inner flank 16, the large base 17 of which is directed towards the outer periphery 18 while the small base 19 is rigidly secured to a hub 20. This fixed sheave 14 is surrounded by an elastomer cover 21 of circular shape having a rim 22 which is directed towards the vertical side 4 of the case 2. This rim 22 assures the holding of the rope 13 on the fixed sheave 14.

In case of normal use, the handling rope 13 is wound partially around the movable sheave 9. In the case of use as lowerer, one of the strands 23 of the rope 13 is passed through the notch 15 and the rope 13 is wound on the fixed sheave 14. If it is desired to hold the rope 13 fast, it is sufficient to wind it several times around the fixed sheave 14. Due to the conicity of the inner flank 16, the different lengths 24, 25 of the rope 13 have a tendency to approach the hub 30 but, due to the thickness of the rope 13, self-locking is obtained by the wedging of the rope 13 on the fixed sheave 14. The rope is held on the fixed sheave 14 by the rim 22 of the elastomeric cover 21.

I claim:

1. A pulley comprising a case having two sides and a top spanning the two laterally spaced sides and otherwise open at a bottom thereof, means on said top for suspending said case, a fixed axle extending between said sides, one of said sides having peripheral notch on a bottom edge thereof, a rotatable first sheave on said axle between said sides, an extension of said axle extending laterally outwardly of said one side, a braking second sheave fixed non-rotatably on said extension, an elastomeric cover of circular shape which is placed over said extension and against an outer side of said second sheave, said first sheave and said second sheave having peripheral surfaces for receiving a line extending over said rotatable first sheave for lifting and lowering objects and extending directly from said rotatable sheave through said notch and then around said fixed sheave for variably braking of the line during longitudinal travel by application of a load force on the line, said cover having a rim which is directed toward said one side of said case to assure the holding fast of said line on said second sheave.

2. A pulley according to claim 1, in which said fixed sheave comprises a conical inner face opposing an outer face of said one side of said case.

* * * * *